US009216426B2

(12) United States Patent
Schneider

(10) Patent No.: US 9,216,426 B2
(45) Date of Patent: Dec. 22, 2015

(54) SOLID CONE NOZZLE

(75) Inventor: Matthias Schneider, Ostfildern (DE)

(73) Assignee: LECHLER GMBH, Metzingen (DE)

( * ) Notice: Subject to any disclaimer, the term of this patent is extended or adjusted under 35 U.S.C. 154(b) by 709 days.

(21) Appl. No.: 13/532,169

(22) Filed: Jun. 25, 2012

(65) Prior Publication Data

US 2013/0001325 A1 Jan. 3, 2013

(30) Foreign Application Priority Data

Jul. 1, 2011 (DE) ..... 10 2011 078 508

(51) Int. Cl.
*B05B 1/34* (2006.01)

(52) U.S. Cl.
CPC ..... *B05B 1/3447* (2013.01)

(58) Field of Classification Search
USPC ..... 239/102.2
See application file for complete search history.

(56) References Cited

U.S. PATENT DOCUMENTS

| | | | | |
|---|---|---|---|---|
| 1,282,176 | A | 10/1918 | Binks | |
| 1,496,924 | A | 6/1924 | Day | |
| 2,303,130 | A | 11/1942 | Moon | |
| 3,275,248 | A * | 9/1966 | O'Brien et al. | 239/487 |
| 3,278,125 | A * | 10/1966 | Lorzing, Jr. et al. | 239/405 |
| 3,547,352 | A | 12/1970 | Hadsel | |
| 4,406,407 | A * | 9/1983 | Aprea et al. | 239/487 |
| 5,224,333 | A * | 7/1993 | Bretz et al. | 60/740 |
| 6,578,777 | B2 * | 6/2003 | Bui | 239/406 |
| 8,690,080 | B2 * | 4/2014 | Myers et al. | 239/463 |
| 2002/0166903 | A1 * | 11/2002 | Mark | 239/470 |
| 2003/0116650 | A1 * | 6/2003 | Dantes et al. | 239/463 |
| 2009/0197214 | A1 * | 8/2009 | Bretz | 431/159 |
| 2009/0236438 | A1 * | 9/2009 | Petrovic | 239/8 |
| 2013/0221135 | A1 * | 8/2013 | Myers | 239/548 |

FOREIGN PATENT DOCUMENTS

| | | | |
|---|---|---|---|
| DE | 76 37 369 | | 3/1977 |
| EP | 0 389 014 | A1 | 9/1990 |
| JP | 38-1856 | | 3/1963 |
| JP | 55-61952 | A | 5/1980 |
| JP | 55-65732 | A | 5/1980 |
| JP | 1-194901 | A | 8/1989 |
| JP | 2-81095 | A | 3/1990 |
| JP | 10-216573 | A | 8/1998 |

(Continued)

OTHER PUBLICATIONS

German Patent Office Examination Report dated Mar. 1, 2012 (4 pages).
Office Action of German Patent Office issued in German Application No. 10 2011 078 508.6 dated Aug. 7, 2014 (5 pages).
Search Report of European Patent Office issued in European Application No. 12171951.2 dated Oct. 2, 2012 with English translation of category of cited documents (7 pages).

(Continued)

*Primary Examiner* — Len Tran
*Assistant Examiner* — Adam J Rogers
(74) *Attorney, Agent, or Firm* — Flynn, Thiel, Boutell & Tanis, P.C.

(57) ABSTRACT

A solid cone nozzle including a nozzle housing and a swirl insert, wherein the nozzle housing has an outlet chamber including a discharge orifice and the outlet chamber is disposed downstream of the swirl insert. The swirl insert has on its external periphery at least one swirl duct, which extends, in a swirl portion, helically or at an angle to the longitudinal center axis of the swirl insert and which extends in the axial direction in an outlet portion, which outlet portion extends from the end of the swirl portion to the downstream end of the swirl duct.

18 Claims, 7 Drawing Sheets

(56) References Cited

FOREIGN PATENT DOCUMENTS

| | | | |
|---|---|---|---|
| JP | 2002-306991 | A | 10/2002 |
| JP | 2003-190843 | A | 7/2003 |
| JP | 2004-8877 | A | 1/2004 |
| JP | 2005-52754 | A | 3/2005 |
| JP | 2005-103367 | A | 4/2005 |
| JP | 2006-130406 | A | 5/2006 |

OTHER PUBLICATIONS

Office Action of Japanese Patent Office issued in Japanese Application No. 2012-146839 with English translation dated Jan. 7, 2014 (5 pages).

Chinese Office Action issued in Appln. No. 201210223866.X dated Apr. 2, 2014 with English translation (16 pages).

* cited by examiner

B-B

A-A

D-D

C-C

SOLID CONE NOZZLE

CROSS REFERENCE TO RELATED APPLICATION

This application claims the priority of German Application No. 10 2011 078 508.6, filed Jul. 1, 2011, the disclosure of which is hereby incorporated by reference in its entirety into this application.

FIELD OF THE INVENTION

The invention relates to a solid cone nozzle comprising a housing and a swirl insert, in which the housing has an outlet chamber including an outlet orifice and in which the outlet chamber is disposed downstream of the swirl insert.

SUMMARY OF THE INVENTION

It is an object of the present invention to provide an improved solid cone nozzle.

To this end, the invention provides a solid cone nozzle comprising a housing and in which a swirl insert, in which the housing has an outlet chamber including an outlet orifice and the outlet chamber is disposed downstream of the swirl insert, wherein the swirl insert has on its external periphery at least one swirl duct that extends, in a swirl portion, helically or at an angle relative to the longitudinal center axis of the swirl insert and that extends in the axial direction in an outlet portion extending from the end of the swirl portion to the downstream end of the swirl duct.

In order to produce a conical jet, it is necessary to cause the stream to rotate upstream of the outlet orifice of the nozzle. This is achieved by guiding the fluid to be ejected through the at least one swirl duct in the swirl insert. The rotational movement of the fluid on leaving the swirl duct results in a pressure gradient in the outlet chamber, in which the static pressure diminishes from the wall of the outlet chamber toward the center of the outlet chamber or the axis of rotation of the outlet chamber. If the static pressure at the center of the outlet chamber and thus in the region of the axis of rotation is too low, it results in a hollow cone jet. By means of the invention, it is possible, surprisingly, to influence the pressure gradient inside the outlet chamber by means of an axially extending outlet portion of the at least one swirl duct such that a solid cone jet is achieved. The length of the outlet portion can serve as a design parameter to influence the distribution of fluid within the solid cone jet. The outlet chamber can, for example, be hemispherical in shape or in the form of a blind hole having a flat or spherical base.

In a development of the invention, a downstream end face of the swirl insert is provided with a recess that is disposed substantially at the center of the swirl insert and that partially intersects the swirl duct.

The provision of such a recess can have a decisive influence on stabilization of the flow conditions in the outlet chamber. Such a recess can also influence the pressure gradient inside the outlet chamber such that a solid cone jet having a uniform distribution of fluid can be achieved. The depth of the recess and its plane of intersection with the at least one swirl duct constitute design parameters to influence the distribution of fluid in the nozzle. Advantageously, the recess intersects the swirl duct in the region of the outlet portion.

In a development of the invention, the recess has a flat, curved or conical base.

The solid cone jet ejected can be influenced by the shape of the base of the recess. By virtue of the different shapes of the base of the recess and also the base of the swirl duct, the plane of intersection of the swirl duct with the recess in the swirl insert alters so that the jet pattern of the solid cone nozzle of the invention can be influenced in this way.

In a development of the invention, two or more swirl ducts are provided on the external periphery of the swirl insert.

Varying the number of swirl ducts also makes it possible to influence the jet pattern. The cross-sections of the swirl ducts can be adjusted to suit the cross-section of the outlet orifice in order to achieve a nozzle that is less susceptible to choking effects.

In a development of the invention, the recess in the end face of the swirl insert partially intersects all swirl ducts.

In this way, a uniform pressure balance can be achieved at the center of the outlet chamber, also when regarded across the cross-sectional plane of the outlet chamber, so that a uniform distribution of fluid can be achieved in the resultant solid cone jet.

In a development of the invention, the at least one swirl duct extends in the axial direction along an inlet portion proceeding from the upstream entry point of the swirl duct, then merges into the swirl portion, and finally extends in the axial direction along the outlet portion.

In this way, it is possible to achieve reduced resistance to flow in the solid cone nozzle of the invention and, particularly when the fluid flows in the axial direction into the swirl portion, to stabilize the flow conditions upstream of the swirl portion.

In a development of the invention, the gradient of the swirl duct relative to the longitudinal center axis of the swirl insert changes within its swirl portion.

It is also possible in this way to influence the jet pattern and the resistance to flow of the solid cone nozzle of the invention.

In a development of the invention, the narrowest cross-section of the nozzle is defined by the outlet orifice.

In this way, it is possible to largely prevent choking effects of the swirl ducts and to provide a nozzle that is on the whole less susceptible to choking problems.

Additional features and advantages of the invention are revealed in the claims and the following description of preferred embodiments of the invention, with reference to the drawings. Individual features of the different embodiments shown can be arbitrarily combined with each other, as required, without going beyond the scope of the present invention.

DETAILED DESCRIPTION

Figure 1:
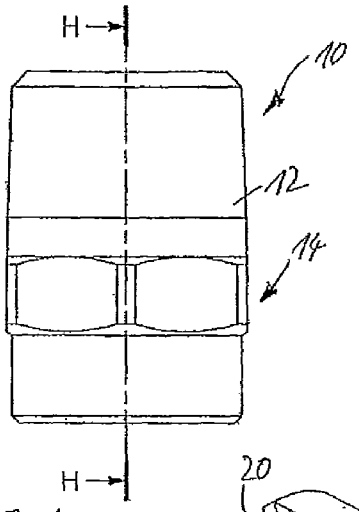
FIG. 1 is a side view of a solid cone nozzle of the invention.

FIG. 1 shows a solid cone nozzle 10 of the invention according to a preferred embodiment of the invention. The solid cone nozzle 10 has a housing 12 that is provided with a hexagonal profile 14 and a screw thread (not shown in the figure) to enable the housing to be screwed onto a connecting line. The housing 12 has a generally cylindrical shape and includes a housing wall 12*a*.

Figure 2:
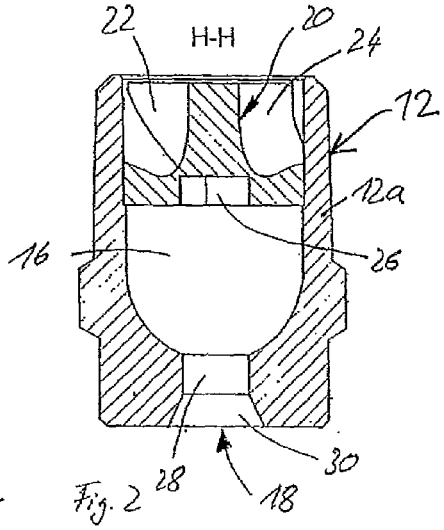
FIG. 2 is a view of the cross-sectional plane H-H indicated in FIG. 1.

FIG. 2 is a view of the cross-sectional plane H-H indicated in FIG. 1. The housing 12 has an outlet chamber 16 and an outlet orifice 18. There is disposed a swirl insert 20 upstream of the outlet chamber 16 in the housing 12. The swirl insert 20 is basically disk-shaped and is provided with two swirl ducts 22, 24 on its external periphery. At its end face in proximity to the outlet chamber 16, the swirl insert is provided with a central recess 26 in the form of a blind hole having a plane base and a circular cross-section.

The outlet chamber 16 is of a plain cylindrical shape in its region adjacent to the swirl insert 20. Downstream of the plain cylindrical portion, the cross-section of the outlet chamber 16 diminishes toward the outlet orifice 18. In this tapered portion, the outlet chamber 16 has an approximately hemispherical shape. The outlet orifice 18 has a first cylindrical portion 28 of circular cross-section and, downstream of this cylindrical portion 28, a conically widened portion 30.

Figure 3:
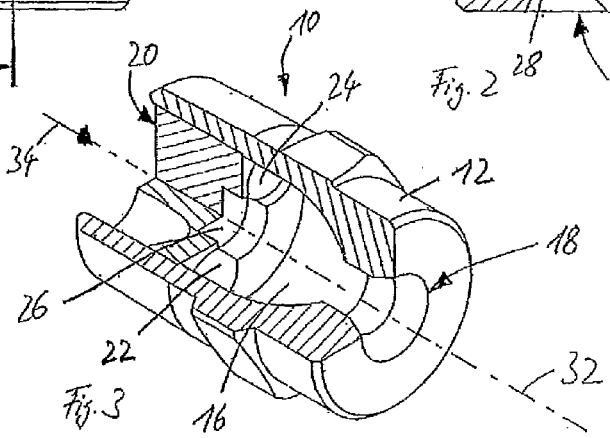
FIG. 3 is a partial cross-sectional view, taken obliquely from above, of the solid cone nozzle shown in FIG. 1.

FIG. 3 shows the solid cone nozzle 10 of the invention in a view taken obliquely from the front, in which the solid cone nozzle 10 is shown as a partial cutout. A first cross-sectional portion extends from the external periphery of the housing 10 to the longitudinal center axis 32 of the nozzle. A second cross-sectional portion extends likewise from the external periphery of the housing 12 to the longitudinal center axis 32 but at right angles to the first cross-sectional portion.

Fluid to be ejected enters the housing 12 in the direction of the arrow 34 and then flows through the two swirl ducts 22, 24. The central recess 26 in the swirl insert 20 intersects the swirl ducts 22, 24 in their outlet regions directly upstream of the outlet chamber 16. Thus fluid can flow into the recess 26. Also, the region of the outlet chamber 16 that surrounds the longitudinal center axis 32 is subjected to fluid pressure such that an excessive pressure difference between the border region of the outlet chamber 16 and the region surrounding the longitudinal center axis 32 can be avoided. In this way, a solid cone jet having a uniform distribution of fluid can be achieved downstream of the outlet orifice 18. The pressure conditions in the outlet chamber 16 and thus the distribution of fluid in the jet cone released are influenced by means of the depth of the recess 26 and also by its plane of intersection with the swirl ducts 22, 24.

Figure 4:
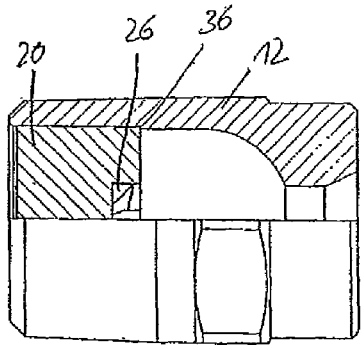
FIG. 4 is a side view of the solid cone nozzle shown in FIG. 3.

FIG. 4 is a partially cross-sectional side view of the solid cone nozzle 10 shown in FIG. 3. It may be discerned from this view that the recess 26 of the swirl insert 20 has a plane base. It can further be seen that the housing 12 is provided with a peripheral shoulder 36 at the upstream end of the outlet chamber, against which peripheral shoulder 36 the swirl insert 20 rests. Thus the swirl insert 20 is fixed in position in the housing 12.

Figure 5:
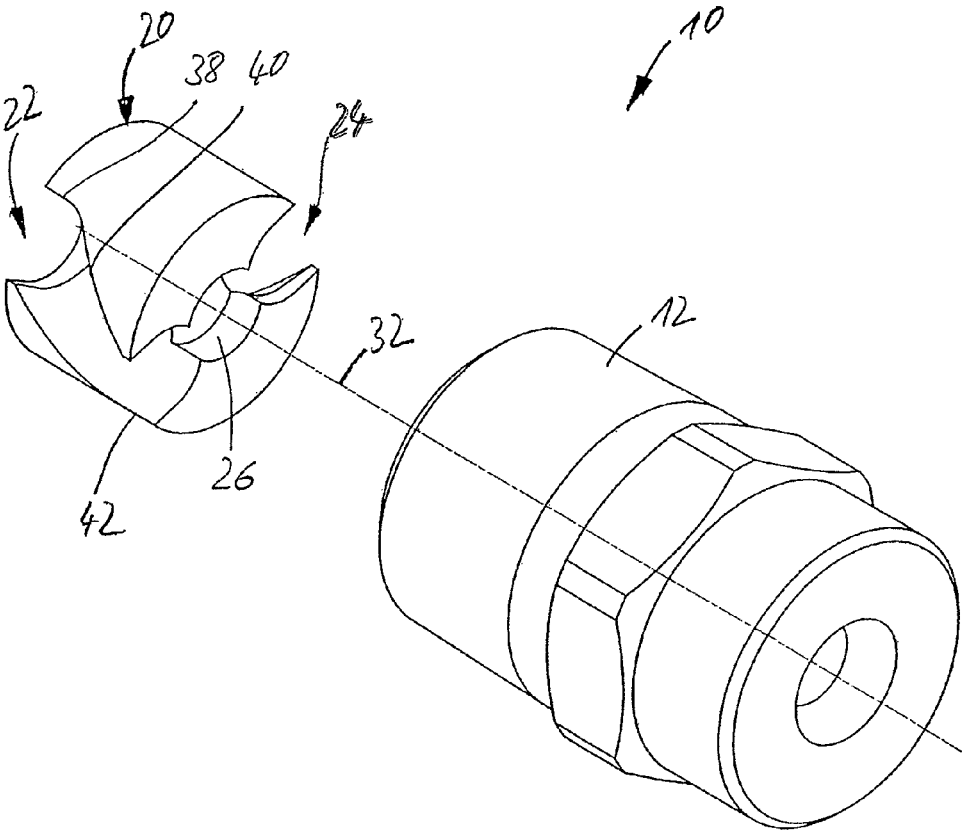
FIG. 5 is an isometric illustration of the solid cone nozzle shown in FIG. 1 in an exploded view.

FIG. 5 shows the solid cone nozzle 10 shown in FIG. 1 in an exploded view taken obliquely from the front. The swirl insert 20 has the shape of a plain cylindrical disk. Each of the two swirl ducts 22, 24 has an inlet portion 38 in which the swirl duct extends in a direction parallel to the longitudinal center axis 32. The inlet portion 38, as regarded in the direction of flow, is followed by a swirl portion 40 in which the swirl ducts extend in a direction at an angle to the longitudinal center axis 32. Each of the outlet portions 42 then extends downstream of the swirl portion 40 toward the downstream end face of the swirl insert 20, in which outlet portions 42 the swirl ducts 22, 24 again extend in a direction parallel to the longitudinal center axis 32. The recess 26 in the swirl insert 20 intersects the swirl ducts 22, 24 in each of their outlet portions 42.

Figure 6:
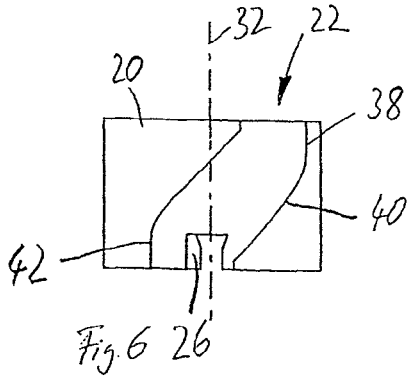
FIG. 6 is a side view of the swirl insert of the solid cone nozzle shown in FIG. 5.

The shape of the swirl duct 22 can be clearly discerned from the side view shown in FIG. 6. The axially extending inlet portion 38 is followed by the obliquely or helically extending swirl portion 40 that is then followed by an again axially extending outlet portion 42. In the embodiment shown, the swirl ducts 22, 24 are produced by means of a spherical milling tool so that the transitions between the inlet portion 38, the swirl portion 40, and the outlet portion 42 are smooth, since the transitions follow a curvature on account of the fact that the cross-section of the swirl duct 22 is semicircular.

The outlet portion extending in the axial direction, that is to say, in a direction parallel to the longitudinal center axis 32, causes the fluid located in the swirl portion 40 of the swirl duct 22 to be deflected, at least partially, in the axial direction into the outlet portion 42. This results in a pressure balance between the border region of the outlet chamber 16 (see FIG. 3) and a center region of the outlet chamber 16 surrounding the longitudinal center axis 32. Thus a solid cone jet is obtained.

The central recess 26 that intersects the swirl ducts 22, 24 in the region of their outlet portions 42 further contributes to achieving such a pressure balance. Thus fluid can flow from the swirl ducts 22, 24 into the recess 26 and thus into the center region of the outlet chamber 16. This can also contribute to achieving a solid cone jet having a uniform distribution of fluid.

Figure 7:
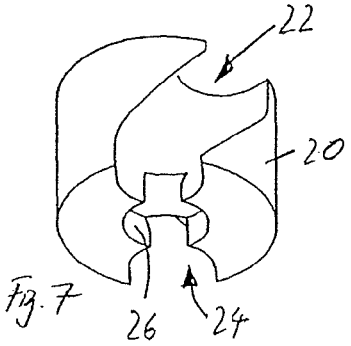
FIG. 7 is a view, taken obliquely from below, of the swirl insert shown in FIG. 6.

FIG. 7 is a view, taken obliquely from below, of the swirl insert 20 shown in FIG. 6.

Figure 8:
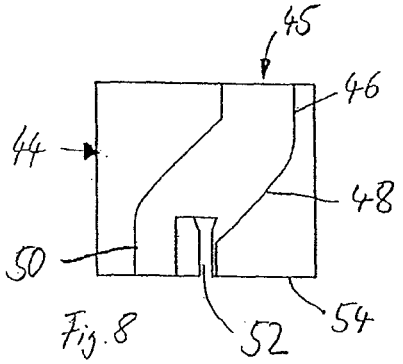
FIG. 8 is a side view of a swirl insert for a solid cone nozzle of the invention according to a second embodiment.

FIG. 8 shows a swirl insert 44 for a solid cone nozzle of the invention. The swirl insert 44 is longer than the swirl insert 20 shown in FIG. 6, and this increased length of the swirl insert is conducive to achieving an elongated inlet portion 46 and an elongated outlet portion 50. The swirl portion 48 of the swirl insert 44 is as long as the swirl portion 40 of the swirl insert 20 shown in FIG. 6. A central recess 52 in a downstream end face 54 of the swirl insert 44 extends substantially over the entire length of the outlet portion 50 and intersects the two swirl ducts 45, 47. As a result of the elongated inlet portion 46 extending in the axial direction and the elongated outlet portion 50 extending in the axial direction, and the likewise elongated central recess 52, it is possible to reduce the pressure difference between the wall of the outlet chamber 16 and the center of the outlet chamber 16 so that more fluid is released at the center of the solid cone jet. The recess 52 is circular in cross-section and has a plane base.

Figure 9:
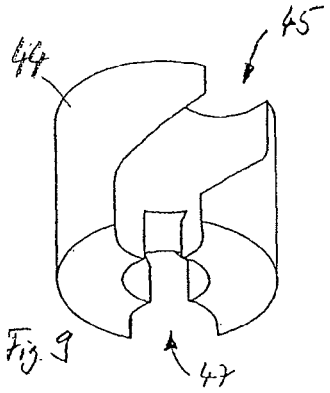
FIG. 9 is a view, taken obliquely from below, of the swirl insert shown in FIG. 8.

FIG. 9 is a view, taken obliquely from below, of the swirl insert 44 shown in FIG. 8.

Figure 10:
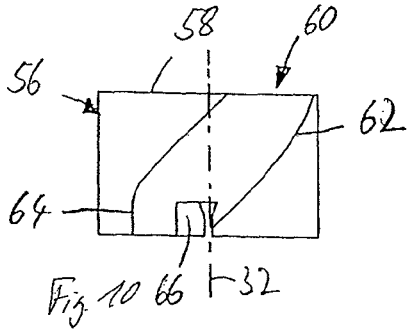
FIG. 10 is a side view of a swirl insert of a solid cone nozzle of the invention according to a third embodiment.

FIG. 10 is a side view of a swirl insert 56 for a solid cone nozzle of the invention. The swirl insert 56 has two swirl ducts 60 that extend from the upstream end face 58 of the swirl insert 56 immediately in a direction at an angle to the longitudinal center axis 32. Thus the swirl ducts 60 do not have an axially extending inlet portion, but rather they comprise only a swirl portion 62 that extends in a direction at an angle to the longitudinal center axis 32 and is followed by an axially extending outlet portion 64. The swirl ducts 60 are intersected in the region of their outlet portions 64 by the central recess 66 in the swirl insert 56.

Figure 11:
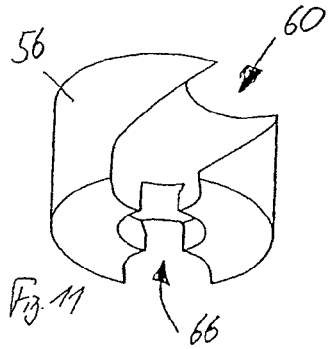
FIG. 11 is a view, taken obliquely from below, of the swirl insert shown in FIG. 10.

FIG. 11 is a view, taken obliquely from below, of the swirl insert 56. In addition to the swirl duct 60, there is provided a second, only partially visible swirl duct 66, which displays, over the region of its swirl portion, the same gradient as that of the swirl duct 60, as it extends along the periphery of the swirl insert 56.

Figure 12:
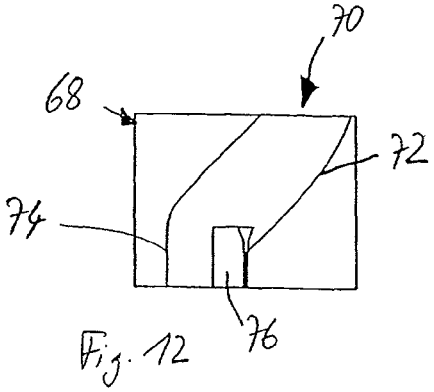
FIG. 12 is a side view of a swirl insert for a solid cone nozzle according to a fourth embodiment of the invention.
Figure 13:
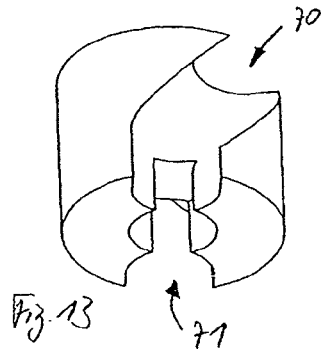
FIG. 13 is a view, taken obliquely from below, of the swirl insert shown in FIG. 12.

FIG. 12 is a side view of a swirl insert 68 for a solid cone nozzle of the invention. The swirl insert 68 is provided with two swirl ducts 70, 71, of which only the swirl duct 70 is visible in the illustration shown in FIG. 12. The swirl duct 70 extends from an upstream end face of the swirl insert 68 immediately in a direction at an angle to the longitudinal center axis so that its swirl portion 72 starts from the upstream end face of the swirl insert 68. This swirl portion 72 is followed by an axially extending outlet portion 74 that is more elongated than the outlet portion 64 of the swirl insert 56 shown in FIG. 10. The central recess 76 is similarly elongated. The elongation of the axial outlet portion 74 and the elongation or increased submersion depth of the central recess 76 results in a smaller pressure difference between the wall of the outlet chamber 16 and the central region of the outlet chamber 16 and thus more fluid is released in the internal region of the solid cone jet.

Figure 14:
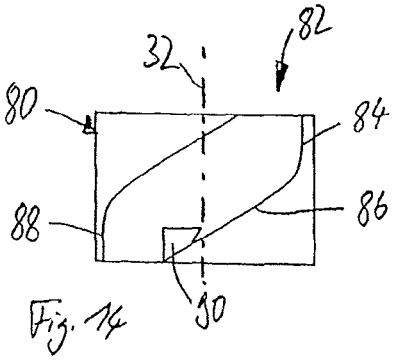
FIG. 14 is a side view of a swirl insert for a solid cone nozzle of the invention according to a fifth embodiment.

FIG. 14 is a side view of a swirl insert 80 for a solid cone nozzle of the invention. The swirl insert 80 is provided with two swirl ducts 82, 83, of which only the swirl duct 82 is visible in the illustration shown in FIG. 14. The swirl duct 82 has an axially extending inlet portion 84, a swirl portion 86 extending in a direction at an angle to the longitudinal center axis, and an axially extending outlet portion 88. A central recess 90 is provided in the downstream end face of the swirl insert and intersects the swirl ducts 82 of the swirl insert 80. The gradient of the swirl duct 82 relative to the longitudinal center axis changes within the swirl portion 86. In this way, a gradual transition can be achieved from the inlet portion 84 to the swirl portion 86 and from the swirl portion 86 to the outlet portion 88.

Figure 15:
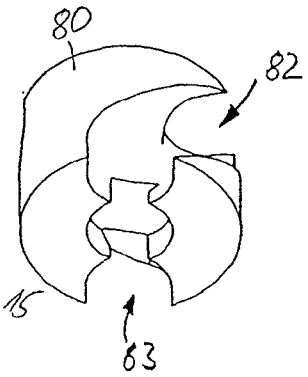
FIG. 15 is a view, taken obliquely from below, of the swirl insert shown in FIG. 14.

FIG. 15 is a view, taken obliquely from below, of the swirl insert 80.

Figure 16:
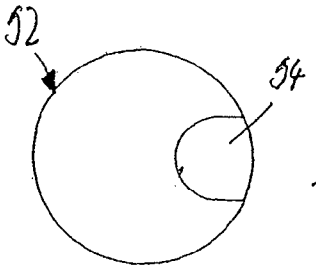
FIG. 16 is a top view of a swirl insert for a solid cone nozzle of the invention according to a sixth embodiment.

FIG. 16 is a top view of a swirl insert 92 for a solid cone nozzle of the invention. The swirl insert 92 has only a single swirl duct 94. In this way, the cross-section of the swirl duct 94 can be maximized so that a solid cone nozzle is achieved that is less susceptible to choking effects.

Figure 17:
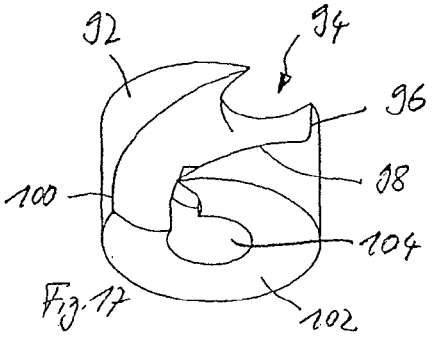
FIG. 17 is a view, taken obliquely from below, of the swirl insert shown in FIG. 16.

FIG. 17 is a view, taken obliquely from below, of the swirl insert 92. The single swirl duct 94 has an axially extending inlet portion 96, a swirl portion 98 extending in a direction at an angle to the longitudinal center axis, and an outlet portion 100 extending axially in relation to the longitudinal center axis. In the downstream end face 102 of the swirl insert 92, there is provided a central recess in the form of a circular blind hole 104 that intersects the swirl duct 104 in the region of its outlet portion 100 and also partly in the region of its swirl portion 98.

Figure 18:
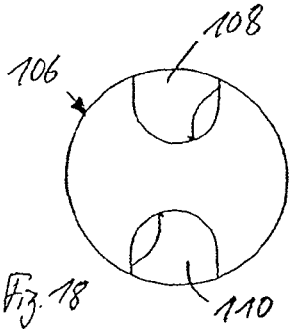
FIG. 18 is a top view of a swirl insert of a solid cone nozzle of the invention according to a seventh embodiment.

FIG. 18 shows a swirl insert 106 for a solid cone nozzle of the invention. The swirl insert 106 is provided with two swirl ducts 108, 110 that are diametrically opposed to each other.

Figure 19:
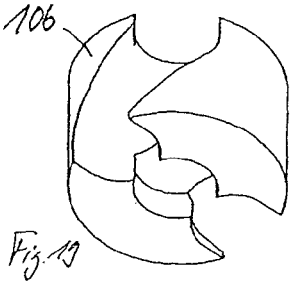
FIG. 19 is a view, taken obliquely from below, of the swirl insert shown in FIG. 18.

FIG. 19 is a view, taken obliquely from below, of the swirl insert 106.

Figure 20:
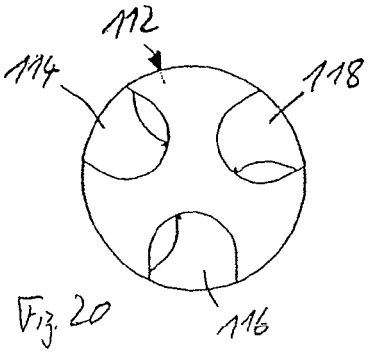
FIG. 20 is a top view of a swirl insert of a solid cone nozzle of the invention according to an eighth embodiment.

FIG. 20 is a top view of a swirl insert 112 for a solid cone nozzle of the invention. The swirl insert 112 is provided with three swirl ducts 114, 116, and 118, each spaced apart from the other by an angle of 120° around the external periphery of the swirl insert 112.

Figure 21:
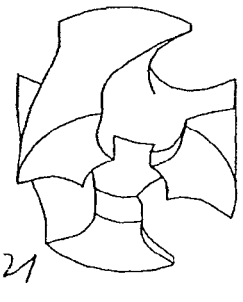
FIG. 21 is a view, taken obliquely from below, of the swirl insert shown in FIG. 20.

FIG. 21 is a view, taken obliquely from below, of the swirl insert 112.

FIGS. 22 to 29 show swirl inserts for solid cone nozzles of the invention that differ from each other merely in terms of the shape of their respective central recesses in the downstream end face of the swirl inserts.

Figure 22:
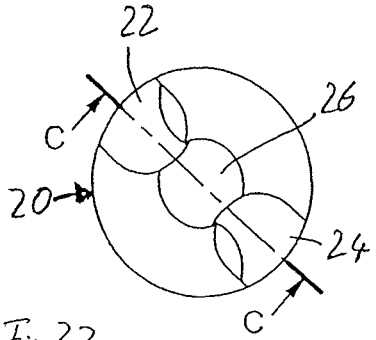
FIG. 22 is a view, taken from below, of the swirl insert shown in FIG. 6.

FIG. 22 is a view, taken from below, of the swirl insert 20 shown in FIG. 6. In addition to the two swirl ducts 22, 24, the recess 26 of circular cross-section is discernable. The recess 26 intersects the swirl ducts 22, 24 in a region directly above the downstream end face of the swirl insert 20.

Figure 23:
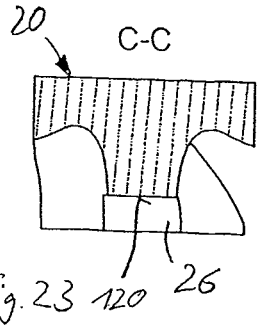
FIG. 23 is a view of the cross-sectional plane C-C indicated in FIG. 22.

FIG. 23 is a view of the cross-sectional plane C-C Indicated in FIG. 22. The central recess 26 has a plane base 120 and is produced, for example, by means of a so-called 180 degree drill. As mentioned above, the depth and shape of the base 120 of the recess 26 form a means of influencing the pressure distribution inside the outlet chamber 16 and thus also the distribution of fluid in the solid cone jet downstream of the outlet orifice 18 (see FIG. 16).

Figure 24:
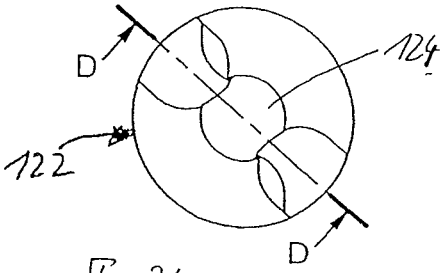
FIG. 24 is a view, taken from below, of a swirl insert for a solid cone nozzle of the invention according to a ninth embodiment.
Figure 25:
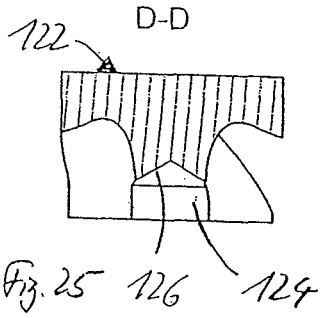
FIG. 25 is a view of the cross-sectional plane D-D indicated in FIG. 24.

FIG. 24 shows a swirl insert 122 for a solid cone nozzle of the invention. With the exception of the central recess 124, the swirl insert 122 is identical to the swirl insert 20 shown in FIG. 20. The recess 124 is likewise circular and its circular shape and diameter are the same as in the recess 26 of the swirl insert 20. Unlike the plane base 120 of the recess 26 of the swirl insert 20, the base 126 of the recess 124 is conical in shape, as may be seen from the view of the cross-sectional plane D-D indicated in FIG. 25. Thus the recess 124 can be produced in the swirl insert 122, for example, by means of a drill having a tip angle, i.e., a drill having a tip angle of 118° in the present example.

Figure 26:
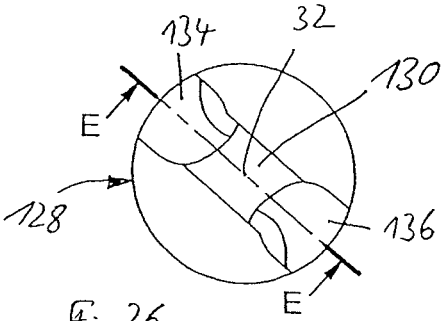
FIG. 26 is a view, taken from below, of a swirl insert for a solid cone nozzle of the invention according to a tenth embodiment.
Figure 27:
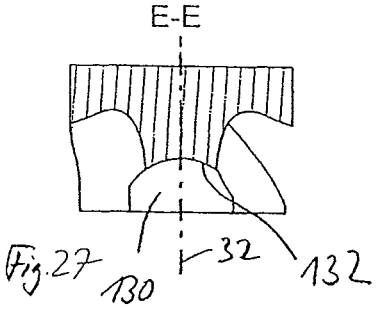
FIG. 27 is a view of the cross-sectional plane E-E indicated in FIG. 26.

FIG. 26 is a view of a swirl insert 128 for a solid cone nozzle of the invention that differs from the swirl insert 20 shown in FIG. 22 only in terms of the shape of the central recess 130. The recess 130 of the swirl insert 128 is produced by inserting a plain cylindrical disk-type side milling cutter. The disk-type side milling cutter is advanced toward the swirl insert 128 in a direction extending parallel to its longitudinal center axis 32. As can be clearly discerned from FIG. 27, the central recess 130 is thus imparted with a base 132 formed as an inwardly curved surface, as regarded in the direction of flow. The curvature of the surface corresponds to the curvature of the outside diameter of the disk-type side milling cutter. In the embodiment shown, the base 132 of the recess 130 is curved only in one direction. Such a shape of the base 132 results from the use of a plain cylindrical milling cutter, the external periphery of which is plane and extends in a direction parallel to the axis of rotation. Similarly, it would also be possible to use, for example, a disk-type side milling cutter that also has a curvature in the direction extending parallel to the axis of rotation.

As may be seen from FIG. 26, the central recess 130 intersects the swirl ducts 134, 136 laterally so that, when use is made of the swirl insert 128, fluid can also flow from the swirl ducts into the recess 130 and thus influence the pressure distribution in the outlet chamber 16 and thus also the distribution of fluid in the solid cone jet ejected.

Figure 28:
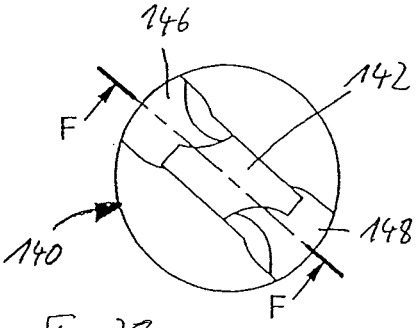
FIG. 28 is a view, taken from below, of a swirl insert for a solid cone nozzle of the invention according to an eleventh embodiment.

FIG. 28 shows a swirl insert 140 for a solid cone nozzle of the invention. The swirl insert 140 differs from the swirl insert 20 shown in FIG. 22 only as regards the shape of its central recess 142. The recess 142 is produced by inserting and moving a plain cylindrical disk-type side milling cutter in the radial direction. Due to the cylindrical shape of the disk-type side milling cutter, the recess 142 is imparted with a plane base 144, as may be seen from FIG. 29.

Figure 29:
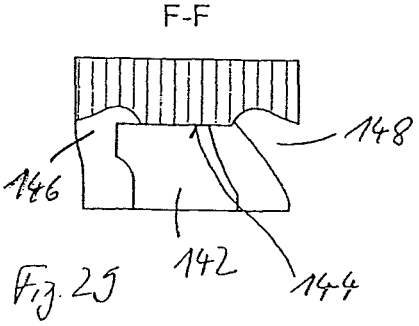
FIG. 29 is a view of the cross-sectional plane F-F indicated in FIG. 28.

FIG. 29 is a view of the cross-sectional plane F-F indicated in FIG. 28. The depth of the central recess 142 in the case of the swirl insert 140 is made comparatively large so that the swirl ducts 146, 148 are intersected by the central recess 142 not only in their axially extending outlet portions but also in their swirl portions extending in a direction at an angle to the longitudinal center axis. The depth and shape of the central recess and also the shape of the base of the recess 144 influence the pressure distribution and the distribution of fluid in the outlet chamber 16 and thus the distribution of fluid in the solid cone jet ejected by the nozzle.

Figure 30:
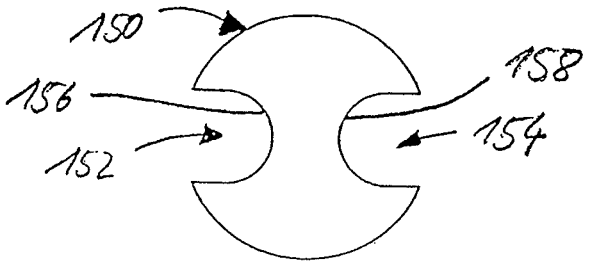
FIG. 30 is a diagrammatical representation of a swirl insert for a solid cone nozzle of the invention for the purpose of illustrating a swirl duct cross-section.
Figure 31:
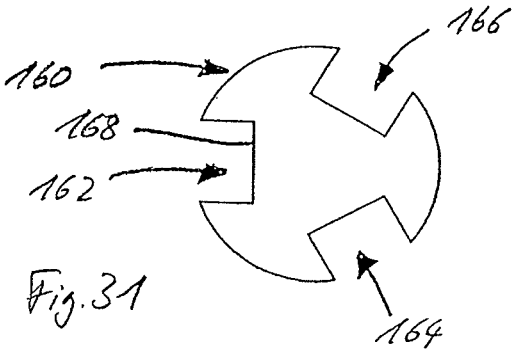
FIG. 31 is a further diagrammatical representation of a swirl insert for a solid cone nozzle of the invention for the purpose of illustrating a swirl duct cross-section.

FIGS. 30 and 31 serve to illustrate various shapes of the swirl ducts and are merely diagrammatical illustrations. A swirl insert 150 shown in FIG. 30 has two diametrically opposed swirl ducts 152, 154 each of which has a semicircular base 156 and 158 respectively. The swirl ducts 152, 154 are produced, for example, by inserting and moving a spherical milling cutter.

FIG. 31 diagrammatically shows a swirl insert 160 that has a total of three swirl ducts 162, 164, 166 that are distributed at regular intervals around the periphery of the swirl insert 160. Each of the swirl ducts 162, 164, 166 has a rectangular cross-section and thus has a plane base 168. The swirl ducts 162, 164, 166 are produced, for example, by inserting and moving a 180 degree drill or milling cutter.

Figure 32:
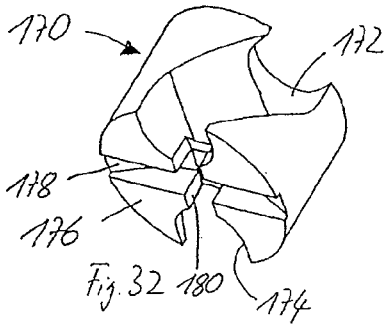
FIG. 32 is a diagrammatical representation of a swirl insert for a solid cone nozzle of the invention according to a twelfth embodiment of the invention.
Figure 33:
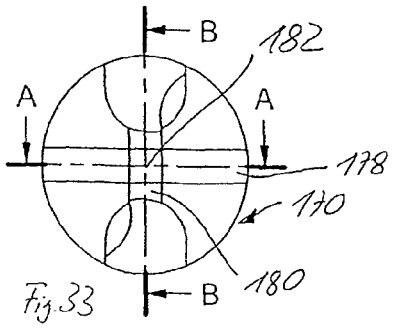
FIG. 33 is a view, taken from below, of the swirl insert shown in FIG. 32.

FIG. 32 is a perspective view of a swirl insert 170 comprising two swirl ducts 172, 174. Two criss-cross recesses 178, 180 are produced in the downstream end face 176 of the swirl insert 170 by means of a disk-type side milling cutter having a cylindrical shape. The recesses 178, 180 intersect at the longitudinal center axis 182 of the swirl insert 170 (see also FIG. 33). Each of the two recesses 178, 180 is produced by advancing a cylindrical disk-type side milling cutter in a direction parallel to the longitudinal center axis 182 into the end face 176 of the swirl insert 170. A pressure balance is achieved in the swirl chamber by means of the recesses 178, 180. The pressure gradient between the swirl chamber and the recesses 178, 180 enables fluid to flow by way of the resulting compensating ducts to the center of the swirl chamber and achieve a pressure balance in this region. The distribution of fluid in the spray jet ejected by the solid cone nozzle comprising the swirl insert 170 and the angle of this ejected spray jet can be influenced by way of the depth of the recesses 178, 180 which in turn is determined by the submersion depth of the disk-type side milling cutter in the direction of the longitudinal center axis 182. The distribution of fluid and the angle of the ejected spray jet can also be influenced by means of the width of the recesses 178, 180, that is to say, by that dimension of each recess extending at right angles to the longitudinal axis of the recesses 178, 180 which is equal to the thickness of the cylindrical disk-type side milling cutter.

Figure 34:
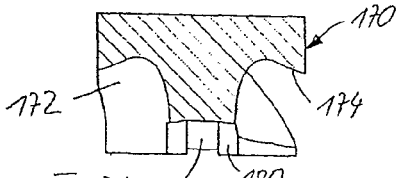
FIG. 34 is a view of the cross-sectional plane B-B indicated in FIG. 33.
Figure 35:
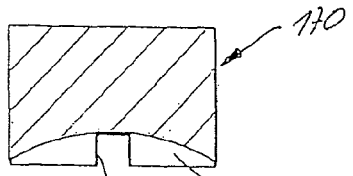
FIG. 35 is a view of the cross-sectional plane A-A indicated in FIG. 33.

The shape of the recesses 178, 180 can also be discerned from the cross-sectional views shown in FIGS. 34 and 35.

Figure 36:
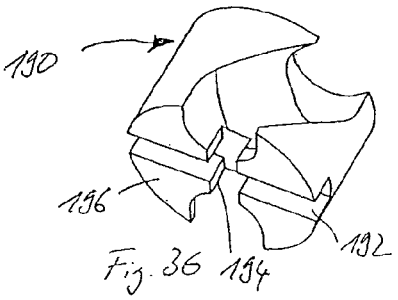
FIG. 36 is a view of a swirl insert for a solid cone nozzle of the invention according to a thirteenth embodiment.
Figure 37:
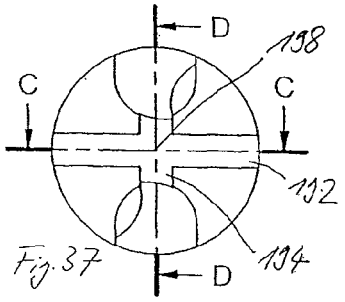
FIG. 37 is a view, taken from below, of the swirl insert shown in FIG. 36.
Figure 38:
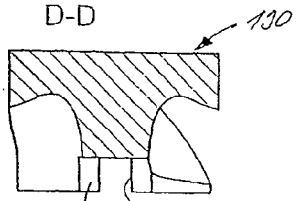
FIG. 38 is a view of the cross-sectional plane D-D indicated in FIG. 37.
Figure 39:
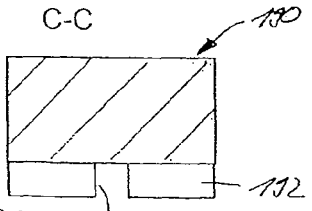
FIG. 39 is a view of the cross-sectional plane C-C indicated in FIG. 37.

FIG. 36 is a perspective view of a swirl insert 190 for a solid cone nozzle of the invention. The swirl insert 190 differs from the swirl insert 170 shown in FIG. 32 merely by the provision of two criss-cross recesses 192, 194 in the downstream end face 196 of the swirl insert 190. Each of the recesses 192, 194 is in the form of a duct of rectangular cross-section and said recesses extend at right angles to each other in the downstream end face 196 of the swirl insert 190. The recesses 192, 194 can be produced by moving a disk-type side milling cutter or a 180 degree milling cutter laterally at right angles to the longitudinal center axis 198 and in a direction parallel to the end face 196. The recesses 192, 194 intersect (see FIG. 37)

at the longitudinal center axis 198. The shape of the recesses 192, 194 can also be discerned from the cross-sectional views shown in FIGS. 38 and 39.

As in the case of the swirl insert 170 shown in FIG. 32, a pressure balance is achieved in the swirl chamber by means of the two recesses 192, 194, since the pressure difference between the swirl chamber and the two recesses 192, 194 enables fluid to flow to the center of the swirl chamber and achieve pressure balance in this region. The distribution of fluid and the angle of the solid jet ejected can be influenced, as in the case of the swirl insert 170 shown in FIG. 32, by means of the depth and width of the recesses 192, 194.

Figure 40:
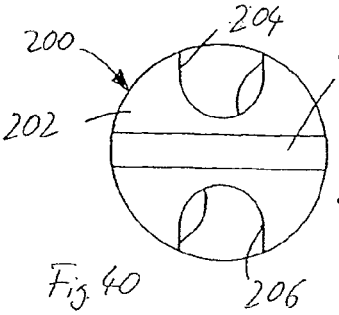
FIG. 40 is a view, taken from below, of a swirl insert for a solid cone nozzle of the invention according to a fourteenth embodiment.

FIG. 40 is a view, taken from below, of a swirl insert 200 for a solid cone nozzle of the invention. The figure represents a view of the downstream end face 202 of the swirl insert 200 into which two swirl ducts 204, 206 open, which are of an identical design to the swirl ducts 172, 174 of the swirl insert 170 shown in FIG. 32.

In the downstream end face 202 there is disposed a recess 208 that is shaped as a duct extending across the end face 202. The recess 208 does not intersect the swirl ducts 204, 206, but rather it extends across the end face 202 at right angles to a direction defined by a line joining the two swirl ducts 204, 206. The width of the recess 208 is made sufficiently small to ensure that the recess 208 does not intersect the region in which the swirl ducts 204, 206 open into the end face 202.

Figure 41:
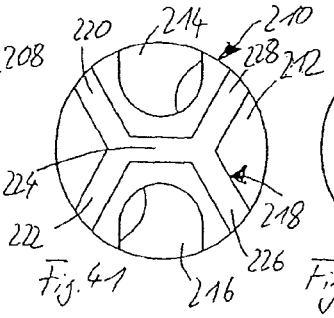
FIG. 41 is a view, taken from below, of a swirl insert for a solid cone nozzle of the invention according to a fifteenth embodiment.

FIG. 41 is a view, taken from below, of a swirl insert 210 for a solid cone nozzle of the invention. Thus FIG. 41 is a view of the downstream end face 212 of the swirl insert 210. Two swirl ducts 214, 216 that are of an identical design as the swirl ducts 172, 174 of the swirl insert 170 shown in FIG. 32 open into this downstream end face 212.

The downstream end face 212 has a recess 218 in the form of a plurality of ducts that do not intersect the swirl ducts 214, 216. More particularly, the recess 218 displays an H-shaped configuration of, in all, five ducts 220, 222, 224, 226, and 228. The ducts 220 and 222 converge in a V-shaped manner, proceeding in each case from the external periphery of the swirl insert 210 and terminating at the point of intersection. The swirl ducts 220, 222 are disposed at an angle of approximately 130° relative to each other. The two ducts 226, 228 are designed as mirror images of the ducts 220, 222 and they thus likewise form a V-shaped configuration that proceeds from the external periphery of the swirl insert 210 and terminates at the point of intersection of the two ducts 226, 228. The point of intersection of the ducts 220, 222 and the point of intersection of the ducts 226, 228 are joined to the duct 224 that terminates at each of these points of intersection. This arrangement results in an approximately H-shaped recess 218 in the downstream end face 212 of the swirl insert 210.

Figure 42:
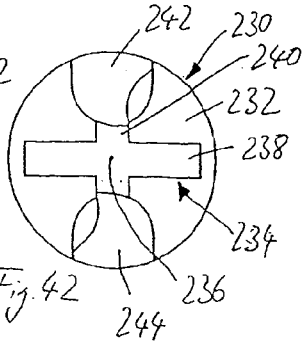
FIG. 42 is a view, taken from below, of a swirl insert for a solid cone nozzle of the invention according to a sixteenth embodiment.

FIG. 42 is a view, taken from below, of a downstream end face 232 of a swirl insert 230 for a solid cone nozzle of the invention. In the end face 232, there is disposed a recess 240 that has two ducts 238, 240 that extend at right angles to each other and intersect at the longitudinal center axis 236. The duct-like recess 240 joins two swirl ducts 242, 244 that are of an identical design as the swirl ducts 172, 174 of the swirl insert 170 shown in FIG. 32. The duct-shaped recess 238 is disposed at right angles to the recess 240, but it does not extend as far as the external periphery of the swirl insert 230. This results in a generally cross-shaped recess 234 in the downstream end face 232 of the swirl.

The invention claimed is:

1. A solid-cone nozzle having an upstream end at which fluid enters the nozzle and a downstream end at which fluid exits the nozzle, the nozzle comprising a nozzle housing and a swirl insert, wherein said nozzle housing has an outlet chamber including a discharge orifice and wherein said outlet chamber is disposed downstream of said swirl insert, wherein said swirl insert has at a periphery thereof at least one swirl duct, said swirl duct has a swirl portion extending helically or at an angle relative to a longitudinal center axis of said swirl insert and an outlet portion extending from an end of the swirl portion to a downstream end of said swirl insert, the outlet portion having a central axis parallel to the longitudinal center axis of the swirl insert to deflect fluid flow from said swirl portion at least partially a direction parallel to the longitudinal center axis, wherein a downstream end face of the swirl insert is provided with a recess disposed substantially centrally with respect to said swirl insert, wherein said recess partially intersects said swirl duct upstream of the downstream end face of the swirl insert.

2. The solid cone nozzle as defined in claim 1, wherein said recess intersects the swirl duct in a region of said outlet portion.

3. The solid cone nozzle as defined in claim 1, wherein said recess has a planar, rounded, or conical base.

4. The solid cone nozzle as defined in claim 1, wherein two or more swirl ducts are provided on the periphery of said swirl insert.

5. The solid cone nozzle as defined in claim 4, wherein said recess in the downstream end face of said swirl insert partially intersects all of the swirl ducts.

6. The solid cone nozzle as defined in claim 1, wherein said swirl duct has an inlet portion which extends in a direction parallel to the longitudinal center axis of the swirl insert starting from an upstream point of entry of the swirl duct, the swirl duct then changing direction along the swirl portion, and the swirl duct finally extending in a direction parallel to the longitudinal center axis of the swirl insert along the outlet portion.

7. The solid cone nozzle as defined in claim 1, wherein a gradient of the swirl duct relative to the longitudinal center axis of said swirl insert changes within said swirl portion.

8. The solid cone nozzle as defined in claim 1, wherein the narrowest interior cross-section of said nozzle is defined by said discharge orifice.

9. The solid-cone nozzle as defined in claim 1, wherein the downstream end face of the swirl insert is defined on the downstream end thereof and is disposed upstream of the outlet chamber.

10. The solid-cone nozzle as defined in claim 9, wherein the recess opens in a downstream direction through the downstream end face of the swirl insert and into the outlet chamber.

11. The solid-cone nozzle as defined in claim 1, wherein the nozzle housing has a hollow interior in which the swirl insert is at least partially disposed, the swirl insert being disposed upstream of the outlet chamber of the nozzle housing and adjacent the upstream end of the nozzle.

12. The solid-cone nozzle as defined in claim 11, wherein the nozzle housing includes a peripheral wall which defines the hollow interior, the swirl duct opening sidewardly through a peripheral surface of the swirl insert such that the swirl duct is defined by both an inner surface of the peripheral wall and the swirl insert.

13. A nozzle comprising a nozzle housing and a swirl insert fixed to said housing, said nozzle having an upstream end and a downstream end spaced from said upstream end wherein fluid flows through said nozzle in a fluid flow direction from said upstream end to said downstream end, said nozzle housing defining therein an outlet chamber having a discharge orifice disposed at said downstream end of said nozzle, said outlet chamber being disposed, with respect to the fluid flow direction through said nozzle, downstream of said swirl insert, said swirl insert having a downstream end face disposed upstream of said outlet chamber and at least one swirl duct disposed adjacent a periphery of said swirl insert, said swirl duct having a swirl portion extending helically or at an angle relative to a longitudinal center axis of said swirl insert and an outlet portion extending in a direction substantially parallel to the longitudinal center axis of said swirl insert from a downstream end of said swirl portion of said swirl duct to said downstream end face of said swirl insert to direct fluid flow from said swirl portion at least partially in a direction substantially parallel to the longitudinal center axis of said swirl insert, said downstream end face of said swirl insert defining therein a recess disposed substantially centrally within said swirl insert and partially intersecting said swirl duct upstream of said downstream end face of said swirl insert so as to be in fluid communication with said swirl duct.

14. The nozzle as defined in claim 13, wherein said outlet portion of said swirl duct and said recess both open into said outlet chamber and both open through said downstream end face of said swirl insert, said recess being disposed radially inwardly from said outlet portion of said swirl duct.

15. The nozzle as defined in claim 14, wherein said outlet portion of said swirl duct opens radially inwardly into said recess for communication therewith.

16. The nozzle as defined in claim 13, wherein said nozzle housing has a hollow interior in which said swirl insert is at least partially disposed, said swirl insert being disposed upstream of said outlet chamber of said nozzle housing and adjacent said upstream end of said nozzle.

17. The nozzle as defined in claim 16, wherein said nozzle housing includes a peripheral wall which defines said hollow interior, said swirl duct opening sidewardly through a peripheral surface of said swirl insert such that said swirl duct is defined by both an inner surface of said peripheral wall and said swirl insert.

18. The nozzle as defined in claim 13, wherein said recess opens in a downstream direction through said downstream end face of said swirl insert and into said outlet chamber.

* * * * *